United States Patent [19]

Okumura et al.

[11] 4,436,783

[45] Mar. 13, 1984

[54] THERMOSENSITIVE RECORDING MATERIAL

[75] Inventors: Fumio Okumura, Kunitachi; Masahiro Higuchi, Tokyo; Shun Kamei, Kitamoto; Masahiro Miyauchi, Tokyo, all of Japan

[73] Assignee: Mitsubishi Paper Mills, Ltd., Tokyo, Japan

[21] Appl. No.: 366,086

[22] Filed: Apr. 6, 1982

[30] Foreign Application Priority Data

Apr. 11, 1981 [JP] Japan ..... 56-54848

[51] Int. Cl.[3] ..... B41M 5/18

[52] U.S. Cl. ..... 428/411; 282/27.5; 428/320.8; 428/488; 428/537; 428/913

[58] Field of Search ..... 282/27.5; 428/320.2, 428/320.4, 320.6, 488, 913, 320.8, 411, 537; 427/150-153

[56] References Cited

U.S. PATENT DOCUMENTS 4,339,492 7/1982 Mino et al. ..... 428/320.4

*Primary Examiner*—Bruce H. Hess

*Attorney, Agent, or Firm*—Cushman, Darby & Cushman

[57] ABSTRACT

A thermosensitive recording material of improved color generation characteristics is obtained by using as the color developer a fused mixture of a conventional color developing bisphenol compound and other phenolic compounds.

14 Claims, No Drawings

THERMOSENSITIVE RECORDING MATERIAL

This invention relates to a thermosensitive recording material of improved color generation characteristics containing essentially a bisphenol compound (color developer) and a dye precursor (color former) which, upon being heated, forms color by reacting with said bisphenol compound.

The thermographic recording system has recently been used in various fields including various printers and telephone facsimile because of its numerous advantages such that it is of non-impact and noiseless type, requires neither development nor fixing treatment, and is easy in maintainance and supervision. It is in rapidly increasing demand particularly in the telephone facsimile. The speed-up of telephone facsimile is now in progress for the purpose of curtailing the transmission cost. In order to keep in step with the speed-up of facsimile, it is required for the thermosensitive record material to increase its sensitivity.

One of the ways to sensitize the thermosensitive recording material is to use a color developer of lower melting point. If two color developers having approximately the same color developing ability are compared with each other, the one having a lower melting point will develop color more easily at lower energy. However, even if a substance has desirable color developing characteristics, they frequently interfere with other characteristics or the substance is costly. A single color developer of desirable overall characteristics has never been found.

The present invention is not directed to a color developer of lower melting point on condition that it is used alone, but is predicated upon the discovery that it is possible to obtain a thermosensitive paper material which is improved in color generation characteristics without the sacrifice of other characteristics, by using as the color developer a fused mixture comprising a bisphenol compound, e.g. 4,4'-isopropylidenediphenol (briefly BPA), which is generally used in conventional thermosensitive paper materials, and other phenolic compound, said fused mixture having a melting point lower than that of the bisphenol compound, e.g. BPA, and an improved color developing ability. The term "fused mixture", as herein referred to, means a mixture formed by fusing together the components.

It is well known that when two different compounds are simply mixed, there occurs generally a phenomenon of melting point depression. The fused mixture used according to this invention differs from the simple mixture of component compounds in characteristics of the substance and in characteristics of the thermosensitive paper material prepared by using the mixture. The difference is described below with reference to a mixture comprising BPA as a bisphenol compound and p-cumylphenol as one of the other phenolic compounds.

1. When heated, a fused mixture (1:1 by weight) of BPA (melting point 156° C.) and p-cumylphenol (melting point 73° C.) begins sintering at 115° C. and shows a sharp melting point at 119°–122° C., whereas a simple mixture (1:1 by weight) of both compounds melts sluggishly, beginning from about 73° C., the melting point of p-cumylphenol, until melting is completed at about 119° C. The reason for such a difference seems to be that in a fused mixture of BPA and p-cumylphenol, a complex of BPA and p-cumylphenol is formed by the hydrogen bonds and the complex behaves like a single compound. This is presumably also responsible for the characteristics of the present thermosensitive paper material, which are different from those of the thermosensitive paper material containing a simple mixture.

2. When a thermosensitive paper material prepared by using a dispersion of the fused mixture (1:1 by weight) of BPA and p-cumylphenol is compared with that prepared by using a mixture (1:1 by weight in terms of solids content) of a dispersion of BPA with a dispersion of p-cumylphenol, the former paper material shows a white ground without stains, whereas the latter paper material shows ground staining (ground fogging), the difference in ground fogging between both paper materials becoming more pronounced after they have been kept at 60° C. for 24 hours.

3. In the case where a phenolic compound such as p-phenylphenol having a melting point (165° C.) higher than that of BPA is used in place of a phenolic compound such as p-cumylphenol having a lower melting point, a fused mixture (6:4 by weight; melting point 126.5°–129° C.) of BPA and p-phenylphenol shows a lower degree of ground fogging, as compared with a mixture (6:4 by weight in terms of solids content) of a dispersion of BPA with a dispersion of p-phenylphenol. Although the sensitivity of a thermosensitive paper material is improved to some degree by use of a simple mixture in place of BPA alone, yet to a greater degree by use of a fused mixture. One of the reasons for this seems to be such that in a thermosensitive coating layer, the probability of contact between the components of a simple mixture is decreased due to the dilution with a pigment and a binder, whereas such is not the case with a fused mixture.

4. An unexpected advantage of the thermosensitive paper material prepared by using a fused mixture over that prepared by using a simple mixture is a greatly decreased stickiness when used in facsimile.

As described above, as compared with a thermosensitive paper material utilizing a bisphenol compound alone, the present paper material utilizing a fused mixture of a bisphenol compound and other phenolic compound has an improved sensitivity sufficient to achieve the object of this invention. Further, as compared with a thermosensitive paper material utilizing a simple mixture of a bisphenol compound and other phenolic compound, the present paper material shows a great degree of improvement in sensitivity, ground fogging, and stickiness.

Examples of chief components used in this invention are given below, but these are merely illustrative and not limitative.

(1) Bisphenol compounds.

Those of the general formula

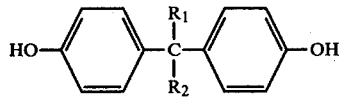

(1)

wherein $R_1$ and $R_2$ each represents a methyl group, ethyl group, propyl group, butyl group, pentyl group, —$COOR_3$, or —$CH_2$—$CH_2$—$COOR_3$ (where $R_3$ represents a hydrogen atom, a lower alkyl group of 1 to 5 carbon atoms, phenyl group, or benzyl group), 1,1'-cyclohexylidenediphenol and bis(4-hydroxyphenyl) sulfone are used.

(2) Other phenolic compounds to be fused together with bisphenol compounds.

As examples, mention may be made of 2,4-dimethylphenol, 2,4-di-tert-butylphenol, 4-tert-butylphenol, 4-octylphenol, 4-cumylphenol, 4-phenylphenol, α-naphthol, β-naphthol, methyl 4-hydroxybenzoate, and benzyl 4-hydroxybenzoate. Mixtures of two or more of these compounds may also be used.

A preferable fused mixture is that of BPA as a bisphenol compound and p-cumylphenol as other phenolic compound to be fused together with BPA. A suitable ratio of BPA to p-cumylphenol is from 5:5 to 8:2, e.g. 5:5. Melting points of fused mixtures of BPA and p-cumylphenol in various ratios are shown in Table 2 given later.

Fused mixtures of BPA and p-phenylphenol may also be used. A desirable weight ratio is from 3.5:6.5 to 7.5:2.5, a ratio of 3:2 being particularly preferred. The melting points of fused mixtures of BPA and p-phenylphenol in various ratios are as shown below:

| BPA/p-phenylphenol by weight | Melting point (°C.) |
|---|---|
| 7:3 | 127.5–133 |
| 6:4 | 126.5–129 |
| 5:5 | 128–143 |
| 4:6 | 130–146 |

Ternary mixtures of BPA, p-phenylphenol and p-cumylphenol may also be used. A suitable weight ratio is 6:4:0.5–3, preferably 6:4:1. Melting points of fused ternary mixtures of BPA, p-phenylphenol and p-cumylphenol in various ratios are as shown below.

| BPA/p-phenylphenol/p-cumylphenol by weight | Melting point (°C.) |
|---|---|
| 6:4:0.5 | 123–128.5 |
| 6:4:1 | 119–124 |
| 6:4:2 | 116–123 |

Further, fused mixtures of BPA and p-octylphenol may be used. A suitable weight ratio is from 6:4 to 4:6. The melting points of fused mixtures of BPA and p-octylphenol in various ratios are as shown below:

| BPA/p-octylphenol by weight | Melting point (°C.) |
|---|---|
| 6:4 | 99–119 |
| 5:5 | 109–113 |
| 4:6 | 98–110 |

(3) Dye precursors.

Those dye precursors generally used in thermosensitive paper materials may be used. Examples include Crystal Violet Lactone, 3-diethylamino-7-methylfluorane, 3-diethylamino-6-chloro-7-methylfluorane, 3-diethylamino-6-methyl-7-chlorofluorane, 3-diethylamino-7-anilinofluorane, 3-diethylamino-7-(2'-chloroanilino)-fluorane, 3-dibutylamino-7-(2'-chloroanilino)fluorane, 3-diethylamino-7-(3'-chloroanilino)fluorane, 3-diethylamino-6-methyl-7-anilinofluorane, 3-(N-ethyl-p-toluidino)-6-methyl-7-anilinofluorane, 3-(N-methylcyclohexylamino)-3-methyl-7-anilinofluorane, and 3-piperidino-3-methyl-7-anilinofluorane.

The invention is further illustrated below with reference to Examples.

EXAMPLE 1

A mixture of 25 g of BPA and 25 g of p-cumylphenol was fused at 140° to 150° C. and poured into stirred warm water to prepare fine particles of a fused mixture (fused mixture A; BPA/p-cumylphenol=5/5; melting point 119°–122° C.). Using 3% (based on total solids) of sodium salt of a styrene-maleic anhydride copolymer as dispersant, an aqueous dispersion of the fused mixture A, 35% in solids content, was prepared by milling in a ball mill for 24 hours. A thermosensitive coating color was prepared from the above aqueous dispersion according to the following formulation:

| | g |
|---|---|
| Calcium carbonate PC (produced by Shiraishi Calcium Co.) | 6 |
| Aqueous dispersion of fused mixture A | 14.3 |
| 30% stearamide dispersion | 16.7 |
| 30% zinc stearate | 3.3 |
| 20% hydroxyethylated starch | 25 |
| 25% Malon MS 25 (sodium salt of styrene-maleic anhydride copolymer) | 4 |
| 30% 3-(N—methylcyclohexylamino)-6-methyl-7-anilinofluorane dispersion | 10 |
| Water | 25 |

The thermosensitive coating color thus prepared was coated on a base paper sheet, 50 g/m$^2$ in basis weight, at a coverage of 6.1 g/m$^2$ on dry basis. After drying, the coated paper sheet was super-calendered to prepare a thermosensitive paper sheet having a Bekk smoothness of 400 seconds.

COMPARATIVE EXAMPLE 1

A thermosensitive paper sheet for the purpose of comparison was prepared in the same manner as in Example 1, except that 14.3 g of a 35% dispersion of BPA was used in place of the dispersion of fused mixture A in the formulation of Example 1.

COMPARATIVE EXAMPLE 2

A thermosensitive paper sheet for the purpose of comparison was prepared in the same manner as in Example 1, except that a mixture of 7.14 g of a 35% BPA dispersion and 7.14 g of a 35% p-cumylphenol dispersion was used in place of the dispersion of fused mixture A in the formulation of Example 1.

EXAMPLE 2

A mixture of 30 g of BPA and 20 g of p-phenylphenol was fused at 150° to 160° C. and poured into stirred warm water to prepare fine particles of a fused mixture (fused mixture B; BPA/p-phenylphenol=6/4; melting point 126.5°–129° C.). Using these fine particles, a 35% dispersion was prepared in the same manner as in Example 1.

A thermosensitive paper sheet was prepared in the same manner as in Example 1, except that 14.3 g of the dispersion of fused mixture B was used in place of the dispersion of fused mixture A in the formulation of Example 1.

EXAMPLE 3

A mixture of 30 g of BPA, 20 g of p-phenylphenol, and 5 g of p-cumylphenol was fused at 150° to 160° C. and poured into stirred warm water to prepare fine particles of a fused mixture (fused mixture C; BPA/p-phenylphenol/p-cumylphenol=6/4/1; melting point 119°-124° C.). Using these fine particles a 35% dispersion was prepared in the same manner as in Example 1.

A thermosensitive paper sheet was prepared in the same manner as in Example 1, except that 14.3 g of the dispersion of fused mixture C was used in place of the dispersion of fused mixture A in the formulation of Example 1.

EXAMPLES 4 TO 9 AND COMPARATIVE EXAMPLE 3

The procedure of Example 1 was repeated, except that in each case the total weight of BPA and p-cumylphenol was 50 g and the weight ratio was varied as described in Table 2.

The thermosensitive paper sheets obtained in Examples 1 to 9 and Comparative Examples 1 to 3 were tested for performance characteristics. The test items were as follows:

(1) Density of generated color:

A facsimile testing apparatus made by Matsushita Denshi Buhin Co. was used. The voltage was kept constant at 16 V and the pulse duration was varied within the range of from 1.0 to 3.3 ms to determine the color density in each case for the purpose of comparison.

(2) Initial ground fogging (3) Ground fogging after each thermosensitive paper sheet has been kept for 24 hours at 60° C.

(4) Stickiness

For the purpose of comparison, the test results obtained in Examples 1 to 3 and Comparative Examples 1 and 2 were summarized in Table 1 and the test results obtained in Examples 4 to 9 and Comparative Example 3 were summarized in Table 2.

TABLE 1

| | (1) Color density Pulse duration | | | | (2) Initial ground | (3) Ground fogging | |
|---|---|---|---|---|---|---|---|
| | 1 ms | 1.6 ms | 2.0 ms | 3.3 ms | fogging | after heating | (4) Stickiness |
| Example 1 | 0.49 | 1.15 | 1.26 | 1.34 | 0.10 | 0.20 | No |
| Comp. Example 1 | 0.27 | 0.75 | 1.01 | 1.33 | 0.10 | 0.19 | Yes |
| Comp. Example 2 | 0.35 | 0.91 | 1.10 | 1.34 | 0.22 | 0.35 | Yes |
| Example 2 | 0.41 | 1.11 | 1.23 | 1.35 | 0.09 | 0.19 | No |
| Example 3 | 0.45 | 1.13 | 1.25 | 1.34 | 0.10 | 0.20 | No |

Note:
The numerical values indicate optical densities, as measured with "Sakura densitometer PDA 45".

It is apparent from Table 1 that as compared with the thermosensitive sheets obtained in Comparative Examples 1 and 2, those obtained in Examples 1 to 3 exhibited a lower ground fog, and a higher color density at a shorter pulse duration, indicating a higher sensitivity.

TABLE 2

| | BPA/PCP ratio | | Sintering point | Melting point | (1) Color density | | | | (2) Initial ground | (3) Ground fogging | |
|---|---|---|---|---|---|---|---|---|---|---|---|
| | BPA | PCP | (°C.) | (°C.) | 1 ms | 1.6 ms | 2.0 ms | 3.3 ms | fogging | after heating | (4) Stickiness |
| Comp. Example 3 | 10 | 0 | — | 156 | 0.27 | 0.75 | 1.01 | 1.33 | 0.10 | 0.19 | Yes |
| Example 4 | 9 | 1 | 135 | 140-149 | 0.32 | 0.93 | 1.11 | 1.34 | 0.10 | 0.19 | Not tested |
| Example 5 | 8 | 2 | 120 | 125-140 | 0.41 | 1.09 | 1.21 | 1.35 | 0.10 | 0.20 | |
| Example 6 | 7 | 3 | 118 | 123-134 | 0.43 | 1.10 | 1.22 | 1.34 | 0.10 | 0.20 | |
| Example 7 | 6 | 4 | 115 | 120-122 | 0.48 | 1.12 | 1.25 | 1.33 | 0.10 | 0.21 | |
| Example 8 | 5 | 5 | 115 | 119-122 | 0.49 | 1.15 | 1.26 | 1.34 | 0.10 | 0.20 | No |
| Example 9 | 4 | 6 | — | 72-114 | 0.54 | 1.20 | 1.28 | 1.33 | 0.21 | 0.33 | Not tested |

Note:
PCP = p-Cumylphenol
The numerical values are values of optical density, as measured with "Sakura densitometer PDA 45".

As is apparent from Table 2, under the conditions of short pulse duration, a sufficiently high color density was manifested when the weight ratio of BPA to p-cumylphenol is 8/2 or less, whereas the ground fogging, both in the initial stage and after heating, becomes significantly high if said ratio is 4/6 or less. It was ascertained, therefore, that a suitable weight ratio of BPA to p-cumylphenol is in the range of from 8/2 to 5/5.

What is claimed is:

1. In a thermosensitive recording material containing essentially a bisphenol compound as color developer and a dye precursor which, upon being heated, forms color by reacting with said bisphenol compound, the improvement whereby the color generating characteristics of the thermosensitive recording material are ameliorated which comprises employing as the color developer a fused mixture of said bisphenol compound and one or more monohydroxy phenolic compounds.

2. A thermosensitive recording material according to claim 1, wherein the bisphenol compound is selected from the group consisting of 4,4'-isopropylidenediphenol, 1,1'-cyclohexylidenediphenol, and bis(4-hydroxyphenyl) sulfone.

3. A thermosensitive recording material according to claim 1 or 2, wherein the monohydroxy phenolic compound used together with the bisphenol compound in the fused mixture is selected from the group consisting of p-octylphenol, p-cumylphenol, and p-phenylphenol.

4. A thermosensitive recording material according to claim 1, wherein the bisphenol compound is 4,4'-isopropylidenediphenol and the monohydroxy phenolic compound used together with said bisphenol compound in the fused mixture is p-cumylphenol.

5. A thermosensitive recording material according to claim 4, wherein the weight ratio of 4,4'-isopropylidenediphenol to p-cumylphenol is from 5:5 to 8:2.

6. A thermosensitive recording material according to claim 5, wherein the weight ratio of 4,4'-isopropylidenediphenol to p-cumylphenol is 5:5.

7. A thermosensitive recording material according to claim 1, wherein the bisphenol compound is 4,4'-isopropylidenediphenol and the monohydroxy phenolic compound used together with said bisphenol compound in the fused mixture is p-phenylphenol.

8. A thermosensitive recording material according to claim 7, wherein the weight ratio of 4,4'-isopropylidenediphenol to p-phenylphenol is from 3.5:6.5 to 7.5:2.5.

9. A thermosensitive recording material according to claim 8, wherein the weight ratio of 4,4'-isopropylidenediphenol to p-phenylphenol is 6:4.

10. A thermosensitive recording material according to claim 1, wherein the bisphenol compound is 4,4'-isopropylidenediphenol and the monohydroxy phenolic compounds used together with said bisphenol compound in the fused mixture are p-phenylphenol and p-cumylphenol.

11. A thermosensitive recording material according to claim 10, wherein the weight ratio of 4,4'-isopropylidenediphenol and p-phenylphenol and p-cumylphenol is 6:4:0.5–3.

12. A thermosensitive recording material according to claim 11, wherein the weight ratio of 4,4'-isopropylidenediphenol and p-phenylphenol and p-cumylphenol is 6:4:1.

13. A thermosensitive recording material according to claim 1, wherein the bisphenol compound is 4,4'-isopropylidenediphenol and the monohydroxy phenolic compound used together with said bisphenol compound in the fused mixture is p-octylphenol.

14. A thermosensitive recording material according to claim 13, wherein the weight ratio of 4,4'-isopropylidenediphenol to p-octylphenol is from 6:4 to 4:6.

* * * * *